US008512176B1

(12) United States Patent
Mathew et al.

(10) Patent No.: US 8,512,176 B1
(45) **Date of Patent: *Aug. 20, 2013**

(54) BAT WITH CIRCUMFERENTIALLY ALIGNED AND AXIALLY SEGMENTED BARREL SECTION

(71) Applicant: Rawlings Sporting Goods Company, Inc, St. Louis, MO (US)

(72) Inventors: Biju Mathew, St. Charles, MO (US); Curtis M. Cruz, Baton Rouge, LA (US); Matthew V. Vacek, Lacrosse, WI (US); Tyler Scott Jessie, West Salem, WI (US)

(73) Assignee: Rawlings Sporting Goods Company, Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/685,704

(22) Filed: Nov. 26, 2012

Related U.S. Application Data

(63) Continuation of application No. 13/479,944, filed on May 24, 2012, now Pat. No. 8,317,640, which is a continuation of application No. 13/108,310, filed on May 16, 2011, now Pat. No. 8,206,250, which is a continuation of application No. 12/695,920, filed on Jan. 28, 2010, now Pat. No. 7,955,200, which is a continuation of application No. 12/412,711, filed on Mar. 27, 2009, now Pat. No. 7,749,115.

(60) Provisional application No. 61/041,617, filed on Apr. 2, 2008.

(51) Int. Cl.
*A63B 59/06* (2006.01)

(52) U.S. Cl.
USPC ..... 473/567

(58) Field of Classification Search
USPC ..... 473/457, 519, 520, 564–568
See application file for complete search history.

(56) References Cited

U.S. PATENT DOCUMENTS

| | | | | |
|---|---|---|---|---|
| 4,014,542 | A * | 3/1977 | Tanikawa | 473/567 |
| 4,931,247 | A * | 6/1990 | Yeh | 264/258 |
| 5,094,453 | A * | 3/1992 | Douglas et al. | 473/566 |
| 5,409,214 | A * | 4/1995 | Cook | 473/564 |
| 5,961,405 | A * | 10/1999 | MacKay, Jr. | 473/566 |
| 5,964,673 | A * | 10/1999 | MacKay, Jr. | 473/566 |
| 6,042,493 | A * | 3/2000 | Chauvin et al. | 473/566 |
| 6,048,283 | A * | 4/2000 | Albarelli, Jr. | 473/567 |
| 6,053,827 | A * | 4/2000 | MacKay et al. | 473/566 |
| 6,733,404 | B2 * | 5/2004 | Fritzke et al. | 473/566 |
| 6,761,653 | B1 * | 7/2004 | Higginbotham et al. | 473/566 |
| 6,776,735 | B1 * | 8/2004 | Belanger et al. | 473/567 |
| 6,949,038 | B2 * | 9/2005 | Fritzke | 473/566 |
| 6,969,330 | B1 * | 11/2005 | Meeker | 473/567 |
| 7,011,588 | B2 * | 3/2006 | Fritzke et al. | 473/567 |
| 7,033,291 | B1 * | 4/2006 | Meeker | 473/567 |
| 7,115,054 | B2 * | 10/2006 | Giannetti et al. | 473/567 |
| 7,163,475 | B2 * | 1/2007 | Giannetti | 473/567 |

(Continued)

*Primary Examiner* — Mark Graham
(74) *Attorney, Agent, or Firm* — Phillip E. Walker; Waddey & Patterson, P.C.

(57) ABSTRACT

A bat having a handle portion, a transition portion attached to the handle portion, and a barrel portion attached to the transition portion. The area(s) adjacent to the central portion of the barrel have an increased performance with respect to the central portion of the barrel to effectively enlarge the sweet spot, or preferred hitting area. At least one member of the barrel is circumferential aligned and axially spaced from another member.

19 Claims, 12 Drawing Sheets

(56) References Cited

U.S. PATENT DOCUMENTS

| | | | | |
|---|---|---|---|---|
| 7,294,073 | B1 * | 11/2007 | Vacek et al. | 473/566 |
| 7,361,107 | B2 * | 4/2008 | Giannetti et al. | 473/567 |
| 7,442,134 | B2 * | 10/2008 | Giannetti et al. | 473/567 |
| 7,534,179 | B1 * | 5/2009 | Vasek et al. | 473/566 |
| 7,534,180 | B1 * | 5/2009 | Vacek et al. | 473/566 |
| 7,749,115 | B1 * | 7/2010 | Cruz et al. | 473/567 |
| 7,955,200 | B1 * | 6/2011 | Cruz et al. | 473/567 |
| 8,206,250 | B1 * | 6/2012 | Cruz et al. | 473/567 |
| 8,317,640 | B1 * | 11/2012 | Cruz et al. | 473/567 |
| 2002/0091022 | A1 * | 7/2002 | Fritzke et al. | 473/566 |
| 2002/0094892 | A1 * | 7/2002 | Chauvin et al. | 473/566 |
| 2004/0053716 | A1 * | 3/2004 | Wu | 473/564 |
| 2006/0025253 | A1 * | 2/2006 | Giannetti et al. | 473/567 |
| 2006/0258490 | A1 * | 11/2006 | Fitzgerald et al. | 473/564 |
| 2008/0070726 | A1 * | 3/2008 | Watari et al. | 473/566 |
| 2008/0234075 | A1 * | 9/2008 | Lancisi | 473/457 |

* cited by examiner

FIG. 8A
Chart 1
| Tube Length (in) | BC (load to .070) |
|---|---|
| 1 | 85 |
| 2 | 170 |
| 3 | 235 |
| 4 | 290 |
| 5 | 320 |
FIG. 8B
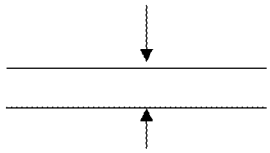
FIG. 8C
Graph 1
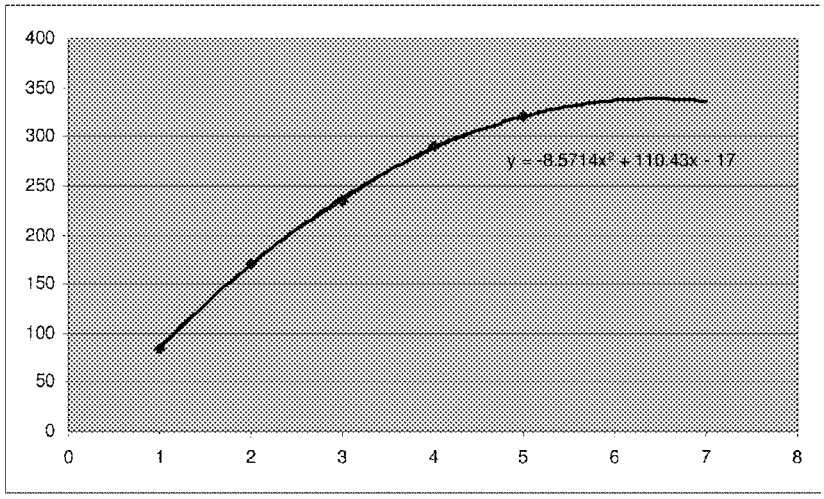

FIG. 9A
Chart 2
| Distance from tube end (in) | BC (load to .070) |
|---|---|
| 0.50 | 177 |
| 1.00 | 225 |
| 1.50 | 285 |
| 2.00 | 315 |
| 2.50 | 335 |
| 3.00 | 350 |
| 3.50 | 350 |
FIG. 9B
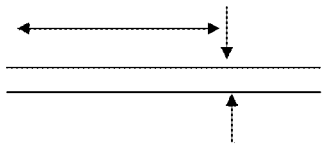
FIG. 9C
Graph 2
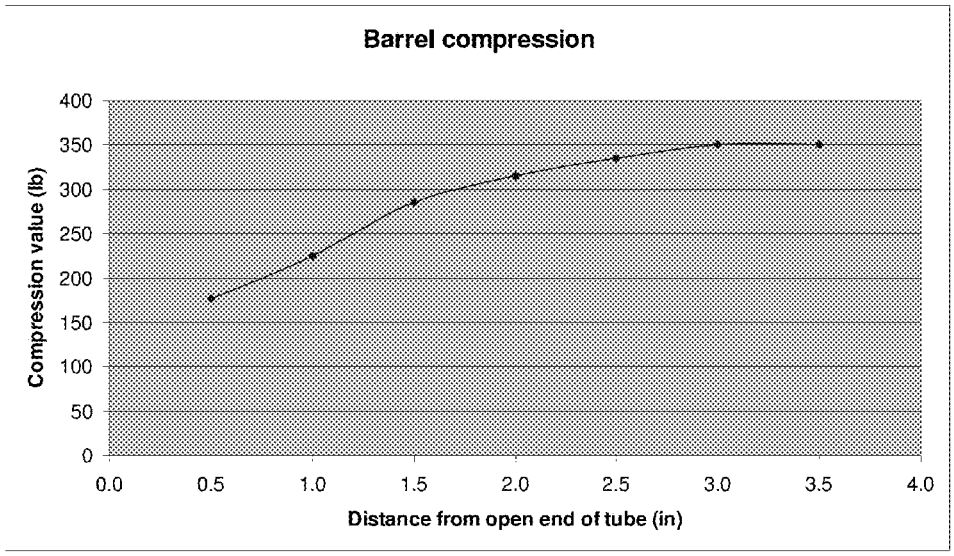

BAT WITH CIRCUMFERENTIALLY ALIGNED AND AXIALLY SEGMENTED BARREL SECTION

This is a continuation application claiming priority to U.S. patent application Ser. No. 13/479,944 filed May 24, 2012, issued as U.S. Pat. No. 8,317,640 on Nov. 27, 2012 and entitled "Bat with Circumferentially Aligned and Axially Segmented Barrel Section", which is a continuation application of U.S. patent application Ser. No. 13/108,310 filed May 16, 2011, issued as U.S. Pat. No. 8,206,250 on Jun. 26, 2012 and entitled "Bat with Circumferentially Aligned and Axially Segmented Barrel Section", which is a continuation application of U.S. patent application Ser. No. 12/695,920 filed Jan. 28, 2010, issued as U.S. Pat. No. 7,955,200 on Jun. 7, 2011 and entitled "Bat with Circumferentially Aligned and Axially Segmented Barrel Section", which is a continuation application of U.S. patent application Ser. No. 12/412,711 filed Mar. 27, 2009, issued as U.S. Pat. No. 7,749,115 on Jul. 6, 2010 and entitled "Bat with Circumferentially Aligned and Axially Segmented Barrel Section", which is a non-provisional application claiming priority to U.S. Patent Application Ser. No. 61/041,617 filed Apr. 2, 2008 and entitled "Bat with Circumferentially Aligned and Axially Segmented Barrel Section."

We, Curtis M. Cruz, a citizen of the United States, residing at 508 Winding Brook Court Lake St Louis, Mo. 63367; Biju Mathew, a citizen of India, residing at 4128 Stonecroft Drive, St. Charles, Mo. 63304; Matthew V. Vacek, a citizen of United States, residing in Brownsville, Minn. 55919 and Tyler S. Jessie, a citizen of United States, residing at 300 Liberty Street, Apt #2200, La Crosse, Wis. 54603; have invented a new and useful "Bat with Circumferentially Aligned and Axially Segmented Barrel Section."

A portion of the disclosure of this patent document contains material that is subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

All patents and publications discussed herein are hereby incorporated by reference in their entirety.

FIELD OF THE INVENTION

The present invention relates generally to bats used in diamond sports, such as baseball and softball bats. More particularly, the invention relates to a bat having an increased performance based upon the barrel configuration. The performance advancement can effective increase the batted ball performance from the bat such that a larger portion of the barrel section can produce a batted ball performance that approximates the maximum batted ball performance allowed by a regulatory agency or body for the particular diamond sport.

BACKGROUND OF THE INVENTION

It can be appreciated that numerous attempts have been made to improve the performance of a bat. These prior attempts have included the addition of various shells, inserts, materials, and shapes of the bat in order to improve its performance or usage. For example, U.S. Pat. Nos. 6,949,038, 6,761,653 6,743,127, 6,733,404, 6,702,698, 6,497,631, 6,176,795, 6,022,282, 4,930,772, 4,331,330, and 3,990,699, and U.S. Patent Application Publication Nos. 2002/0016230, 2002/0091022, and 2005/0070384 disclose various attempts to improve the performance or use of a bat.

The performance of a bat is generally based upon the weight of the bat, size of the bat, and the impact response of the bat at and during impact with a ball. Most of the focus for improvements in bat technology has been in improving the performance of the preferred impact area, or sweet spot. As the prior art bats have increased the performance in this area, many of the sports regulatory agencies have placed performance and/or configuration restrictions on the bats. These restrictions have mandated new innovations in the development of the bat technology.

For example, one regulatory body requires a maximum performance from a bat when impacted in the preferred impact area, or sweet spot of the bat. Typically, this location is approximately six inches from the end of the bat. As such, the current maximum performance for the bat in its preferred hitting area is limited by these regulations. However, it is also to be understood that the area to either side of the sweet spot on a prior art bat has a significant drop off in performance.

The contemporary bat art has made few attempts to improve the performance of the bat sections adjacent the preferred impact area. As such, the performance of the bats in areas distal from, and even adjacent to, the sweet spot dramatically drops for the conventional bats. The portion of the prior art that has attempted to address this need has drawbacks.

For example, U.S. Pat. No. 6,949,038 issued Sep. 27, 2005 discloses increasing the thickness over the sweet spot of the barrel in order to increase the leaf spring effect of the bat. However, this patent fails to reduce the thickness of any wall within the bat in order to increase performance of the bat or vary, or stack, wall layers along the axis of the bat. As such, this patent increases the weight of the bat in an attempt to increase the performance of the bat, which is counter productive. This patent also increases the cost of the bat by increasing the amount of material used.

U.S. Pat. No. 6,761,653 issued Jul. 13, 2004 recognizes the advantages of placing a more durable material in the sweet spot than on either side of the sweet spot to provide the most durable material at the point(s) of maximum bending or deflection. However, the '653 patent fails to recognize any performance benefits and simply uses concentric layers of material stacked in a radial direction along the barrel length.

Thus, there is a continuing need for improved overall performance of bats. These improved bats need to conform to the regulatory agencies' restrictions in the preferred hitting zone while performing well at location that are longitudinally outside the preferred hitting zone. This needed bat should increase the performance in area(s) adjacent the preferred hitting zone as compared to the preferred hitting zone. As such, what is needed is a bat that varies the stiffness of the wall of the bat in order to enhance performance of the bat.

BRIEF SUMMARY OF THE INVENTION

Disclosed herein is a bat for striking a ball. The bat comprises an axis, a handle portion having a knob, a transition portion attached to the handle portion opposite the knob, and a barrel portion attached to the transition portion. The barrel portion includes an end cap end, a handle end, a barrel end, and first and second tubular members. The first tubular member includes a first radius and a first length, wherein the first tubular member is longitudinally positioned along the axis between the end cap end and the handle end. The second tubular member includes a second radius and a second length wherein the second radius is approximately equal to the first radius. The second tubular member is separate from the first tubular member and longitudinally positioned along the axis between the first tubular member and the end cap end of the barrel.

Each tubular member can include a center section, two ends, and a variable radial stiffness. This radial stiffness varies along the length of each tubular member and is greater in the center section than it is at either end of the tubular members.

The first tubular member can be composed of a fiber wound around the frame at a first angle relative to the axis of the bat while the second tubular member can be composed of a fiber wound around the frame at a second angle in relation to the axis of the bat.

In a bat made in accordance with the current disclosure, the barrel can include first and second cylindrical members with each cylindrical member including an inside and an outside diameter. The inside and outside diameters can be approximately equal with each cylindrical member separated from the other and positioned along the longitudinal axis of the bat. The second cylindrical member can be positioned between the first cylindrical member and the end cap end of the barrel. The first and second cylindrical members can circumferentially surround a frame that extends the barrel length. The axis of each tubular member can be substantially in a line with the longitudinal axis of the bat.

Additionally, a third cylindrical member can be included as a part of the barrel. This third cylindrical member can include a third inside diameter, a third outside diameter, and a third radius. The third inside diameter and third outside diameters can be approximately equal to the first and second inside diameters and outside diameters, respectively. The third radius can be approximately equal to the first and second radii. The third cylindrical member is separated from the first and second cylindrical members and is longitudinally positioned along the axis of the bat between the first cylindrical member and a tapered end of a barrel.

It is therefore a general object of the present invention to provide a bat with an improved batted ball performance.

Another object of the present invention is to provide a bat having an improved barrel.

Still another object of the present invention is to provide a bat having multiple tubular members in a barrel section.

Another object of the present invention is to enlarge the effective preferred hitting area of the bat.

Still another object of the present invention is to provide a bat having an enlarged sweet spot.

Yet still another object of the present invention is to provide a bat with a variable radial stiffness in the barrel section.

Yet another object of the present invention is to provide a bat which meets regulatory standards in the preferred hitting area as well as the areas adjacent to it.

Other and further objects, features and advantages of the present invention will be readily apparent to those skilled in the art upon reading of the following disclosure when taken in conjunction with the accompanying drawings.

BRIEF DESCRIPTION OF THE SEVERAL VIEWS OF THE DRAWINGS

FIG. 8A is a chart of test data of how tubular length affects the resistance to barrel compression for a given load.

FIG. 8B is a simple illustration of the general applied load for the test data of FIG. 8A.

FIG. 8C is a graph of the test data of FIG. 8A.

FIG. 9A is a chart of test data of how the distance the load is applied from the open tube end affects the resistance to barrel compression in the tubular structure.

FIG. 9B is a simple illustration of the general applied load for the test data of FIG. 9A.

FIG. 9C is a graph of the test data of FIG. 9A.

DETAILED DESCRIPTION OF THE INVENTION

Figure 1:
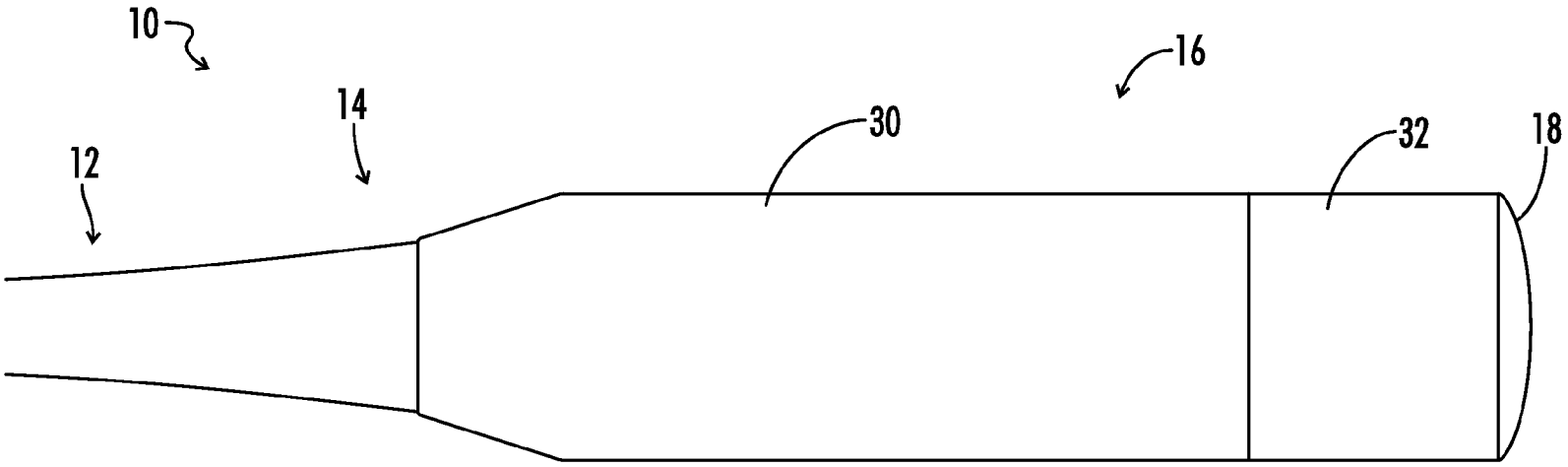
FIG. 1 is a side partial view of a bat made in accordance with the current disclosure.

Referring generally now to FIGS. 1-6, there is shown generally at 10 one embodiment of the bat of the present invention. The bat 10 comprises a handle portion or handle 12, a transition portion or taper portion 14, and a barrel portion or barrel 16. A longitudinal axis 11 runs the length of the bat 10. The transition portion 14 is preferably attached to the handle portion 12, while the barrel portion 16 is attached to the transition portion 14. An end cap 18 is traditionally placed on the end of the barrel portion 16 distal from the taper 14. A knob 20 is traditionally attached to the handle 12 on the end of the handle 12 distal from the barrel portion 16. Each bat has a preferred hitting section 22 that can also be called the sweet spot. In a traditional bat, the sweet spot 22 lies in the middle portion of the barrel portion.

The barrel portion 16 includes an end cap end 24, a handle end 26 and a barrel length 28. First and second tubular members 30 and 32 are also included in the barrel portion 16. The first tubular member 30, which can also be described as first cylindrical member, includes a first radius 34, a first length 36, first inside diameter 38 and first outside diameter 40. The second tubular diameter 32 includes a second radius 42, a second length 44, a second inside diameter 46, and a second outside diameter 48.

The first tubular member 30 is longitudinally positioned along the axis 11 between the end cap end 24 and the handle end 26. The second tubular member 32 is separated from the first tubular member 30 and longitudinally positioned along the axis 11 between the first tubular member 30 and the end cap end 24 of the barrel 16.

The first tubular member 30 is circumferentially positioned between the second tubular member 32 and the handle end 26 of the barrel portion 16. The first outside diameter 40 and the second outside diameter 48 can be approximately equal, while the first inside diameter 38 and the second inside diameter 46 can be approximately equal. Preferably, approximately equal dimensions, including the diameters and other dimensions discussed herein, allow for manufacturing tolerances and small variances in the material thicknesses.

Each tubular member can include a center section 50 and two ends 52 and 54. The first tubular member includes a variable first radial stiffness along the first length 36 while a second tubular member 32 includes a second variable radial stiffness along the second length 44. The variable radial stiffness of each tubular member 30 and 32 is greater in the center section 50 than at either end 52 or 54 of the respective tubular member 30 or 32.

Figure 1A:
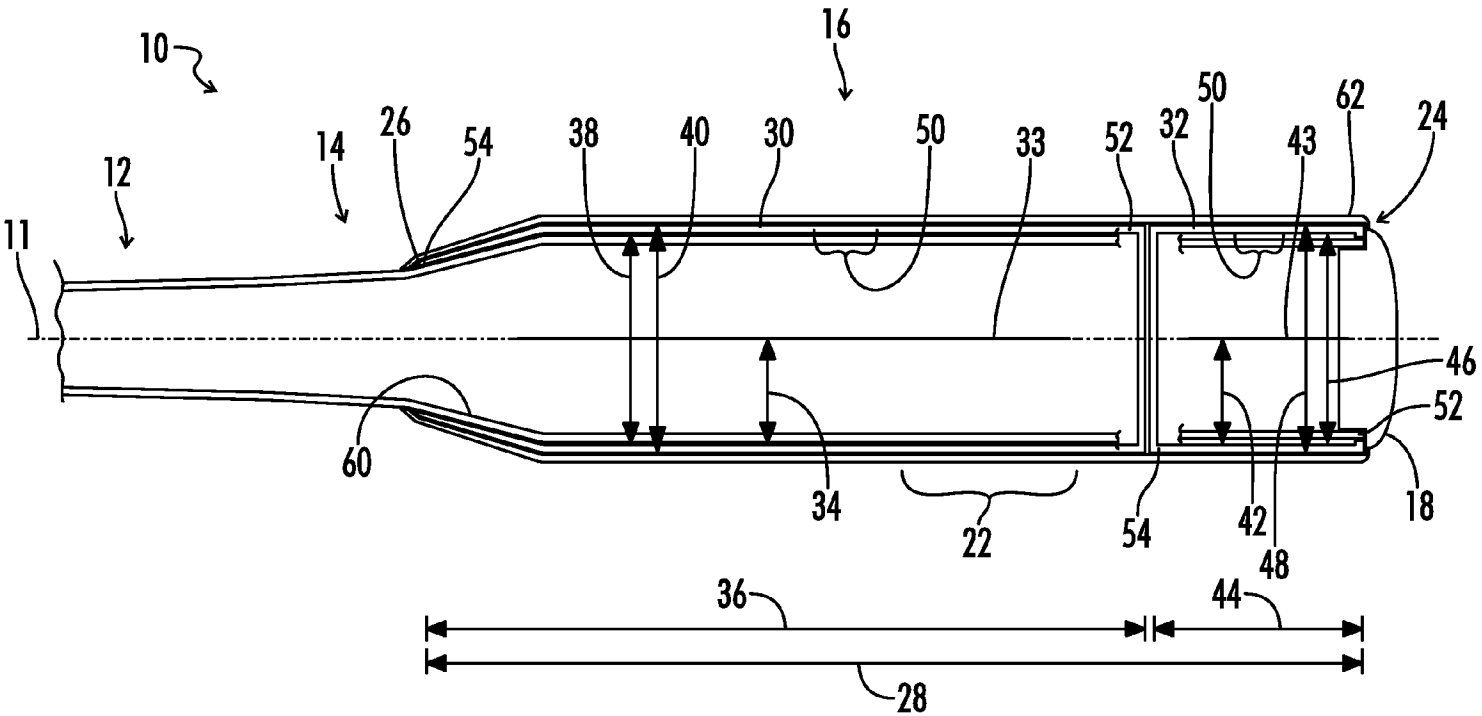
FIG. 1A is a cross-sectional view of the bat shown in FIG. 1.
Figure 2:
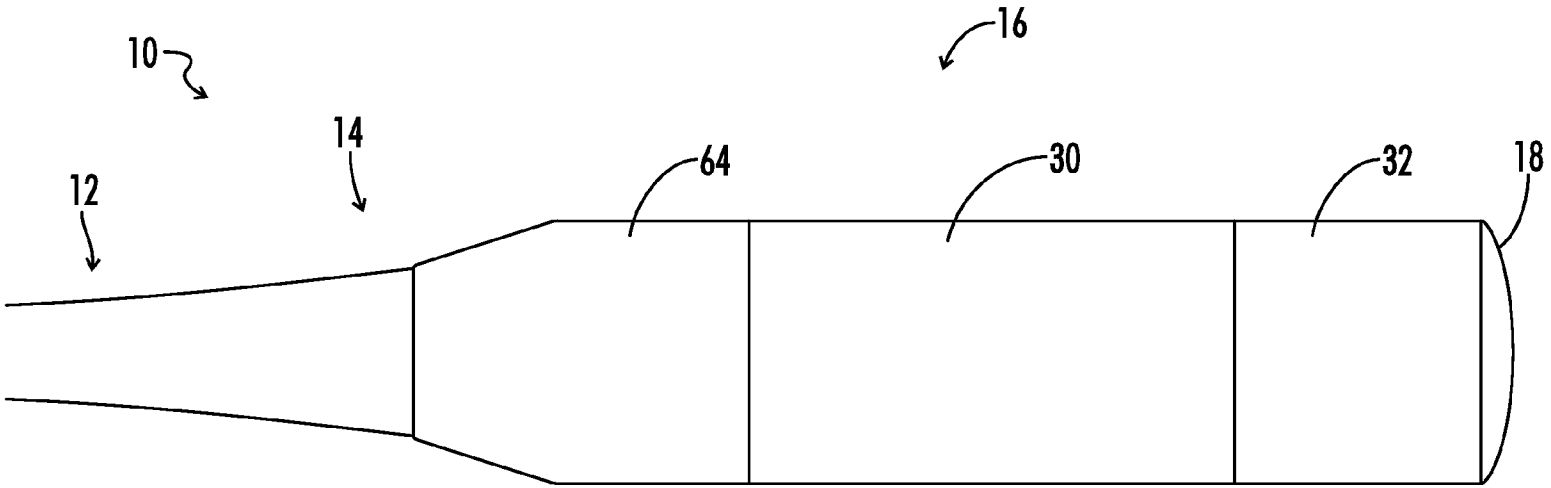
FIG. 2 is a side partial view of a bat made in accordance with the current disclosure.
Figure 2A:
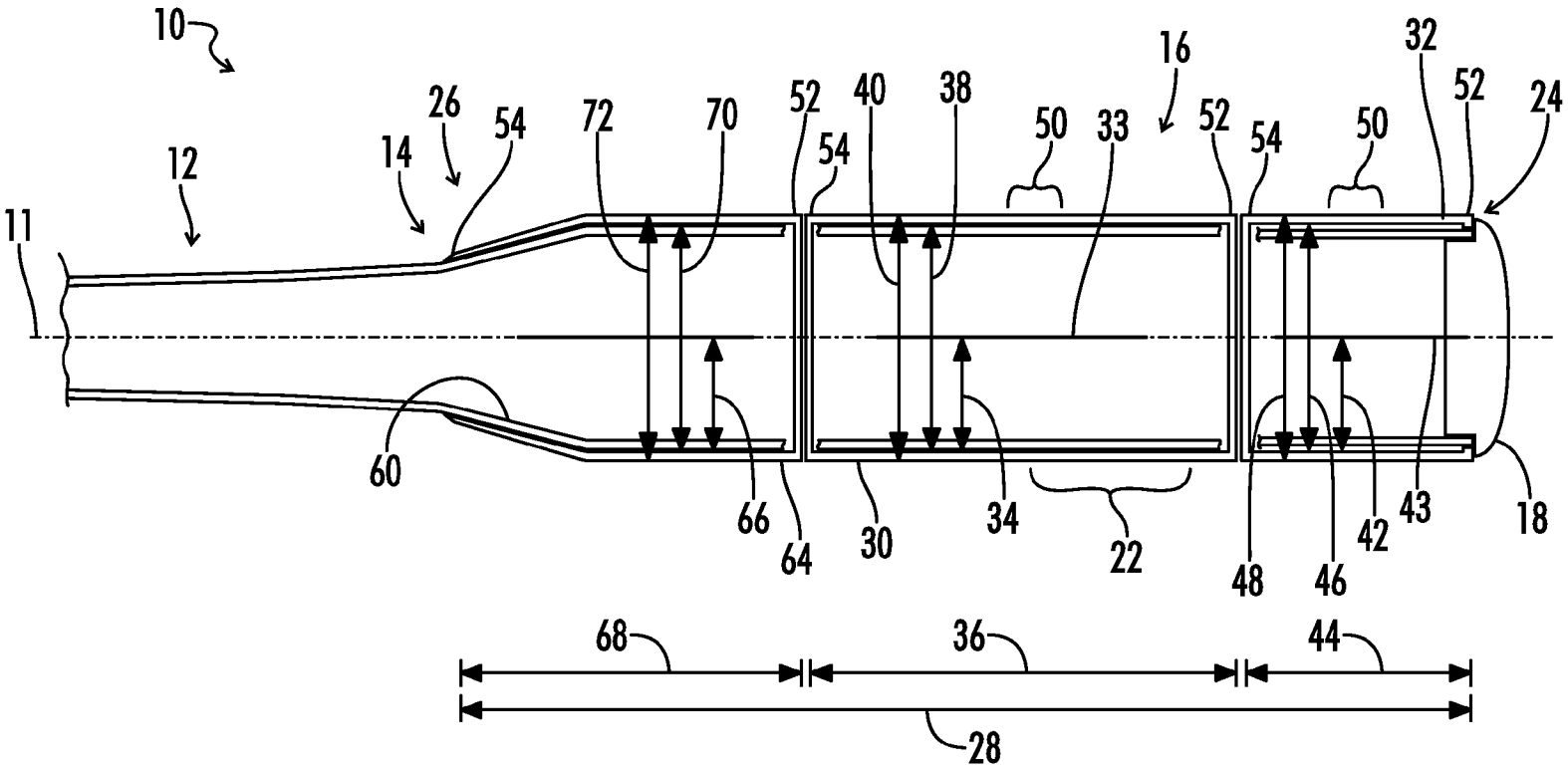
FIG. 2*a* is a cross-sectional view of the bat shown in FIG. 2.
Figure 3:
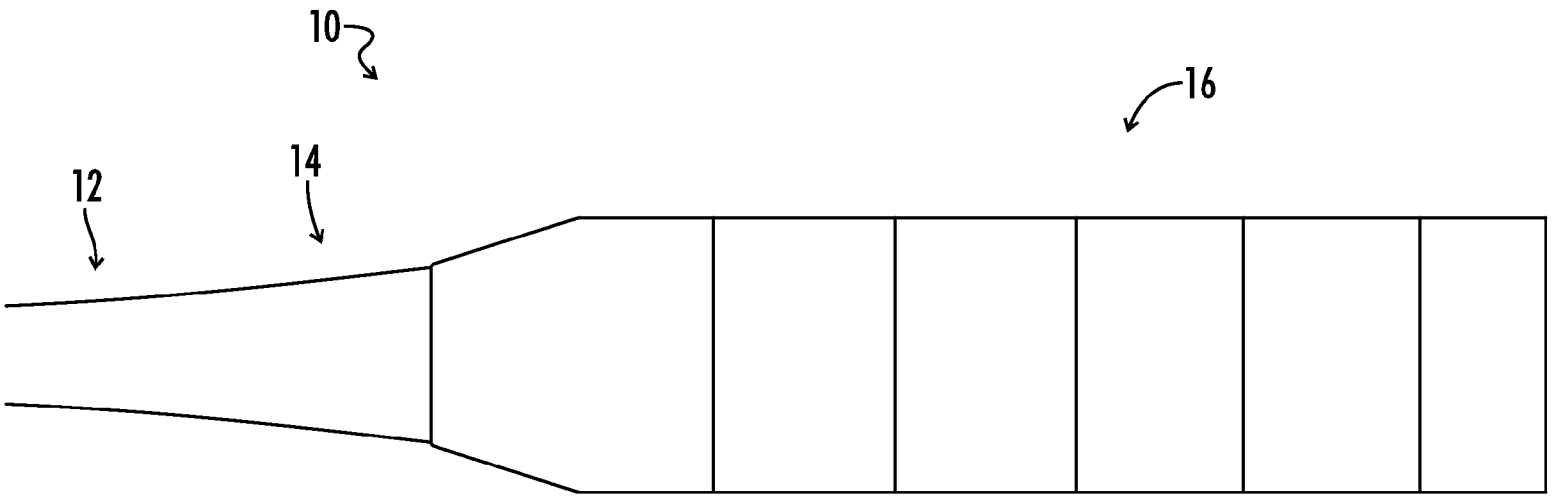
FIG. 3 is a side partial view of a bat made in accordance with the current disclosure.
Figure 3A:
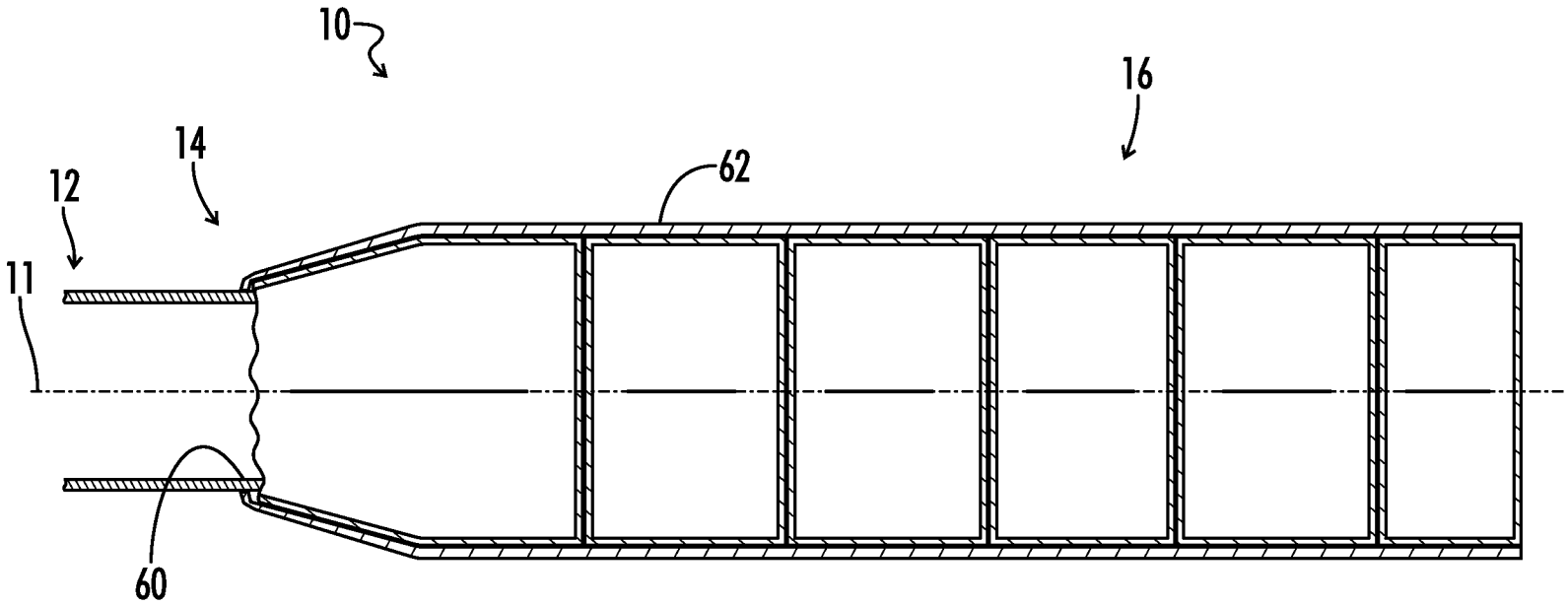
FIG. 3A is a cross-sectional view of the bat shown in FIG. 3.

The bat can further include a frame 60 that extends the barrel length 28 and the tubular members 30 and 32 can form a shell around the frame 60. The frame 60 can include the handle portion 12 and extend substantially from the knob 20 to the end cap end 24 of the barrel portion 16. Additionally, an envelope 62 can cover the tubular members 30 and 32 to promote a smooth exterior to the bat. The envelope 62 can be a clear coat substance, a metal structure, a composite structure, or similar materials. In FIGS. 1A, 2A and 3A portions of the frame 60 are shown as broken to assist in the illustration of the separation between the tubular members.

Additionally a third tubular member 64 can be included. The third tubular member 64 can include a third radius 66, a third length 68, an inside diameter 70 and third outside diameter 72. The third radius can be approximately equal to the first and second radii 34 and 42. The third tubular member 64 is separated from the first and second tubular members 30 and 32 and longitudinally positioned along the axis 11 between the first tubular member 30 and the handle end 26 of the barrel portion 16.

Additional tubular members can be included and longitudinally spaced along the barrel portion 16, and potentially a portion of the transition portion 14, to enhance the performance of the bat 10. For example, FIGS. 3 and 3A are shown with six tubular members spaced as such. In these embodiments the inside diameters and outside diameters are approximately equal for each tubular member up until any part of the barrel portion begins to taper and correspond with the transition portion 14. These substantially equal inside diameters and outside diameters can facilitate a substantially uniform size of the barrel 16. Each tubular member is separated from the other tubular members and longitudinally positioned along the axis 11 between the end cap end 24 and handle end 26 of the barrel portion 16. These tubular members 30 can circumferentially surround a frame 60, while an envelope 62 can cover, or circumferentially surround, these tubular members.

Additionally, the first tubular member can include a first axis 33 while the second tubular member 32 can include a second axis 43. Both axes 33 and 43 are preferably co-linear with the longitudinal axis 11 of the bat 10. The tubular members 30 and 32 are circumferentially positioned between the handle end 26 and end cap end 24 of the barrel 16. These axes 33 and 43 can be described as being substantially co-linear with each other and with the longitude and axis 11. Practically, these axes can be offset minor amounts, including variances in manufacturing tolerances for the production of the bat 10, and still maintain a substantially cylindrical shape to the bat 10 and barrel 16 and preferred performance levels of the bat 10. However, any offset that would affect performance of the bat is undesirable and preferably avoided.

The barrel portion can be comprised of composite material, metal and other materials that can withstand the impact of the ball with the bat 10 and have satisfactory performance characteristics can be used. If composed of composite, the first tubular member 30 can be composed of fiber wound around the frame 60 at a first angle while the second tubular member 32 can be composed of fiber wound around the frame 60 at a second angle. For example, 30 degree fiber angles and braids, as measured off a line perpendicular to the frame 60, can be used to make the first tubular member 30 while fiber angles positioned in an opposite direction, such as laying at approximately 60 degrees, as measured off a line perpendicular to the frame 60, can be used to make the second tubular member fiber angles and braids. Other ranges for these fiber angles can include a range of zero to 90 degrees for the first tubular member 30, as measured off a line parallel to the axis of the frame 60, and a range of zero to 90 degrees for the second tubular member 32, as measured off a line perpendicular to the frame 60. Alternately, the angle range for the first tubular member 30 can be measured off a line perpendicular to the frame 60 while the angle range for the second tubular member 30 can be measured off a line parallel to the axis of the frame 60. These fiber angles can have additional effects on the performance of the bat. For example, fiber angles approaching a parallel position with respect to the axis of the frame 60 increase the handle stiffness of the bat while fiber angles approaching a perpendicular position with respect to the to the axis of the frame 60 decrease the trampoline effect of the bat.

These angles can also be varied for any additional tubular members added. Alternately, the fiber angles for various tubular members within the barrel can be cut at the same angle, can be cut at a mirror image angle or can be cut to alter the performance of that particular section of the barrel as desired.

Figure 4:
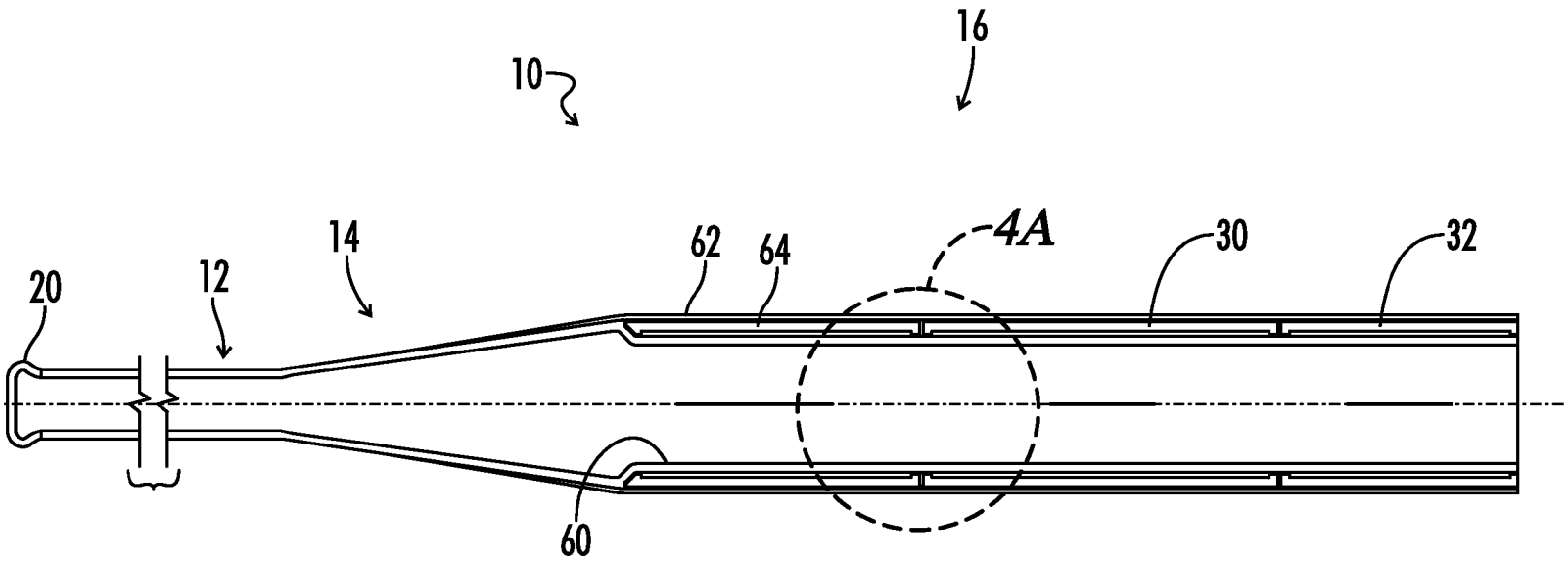
FIG. 4 is a cross-sectional view of a bat made in accordance with the current disclosure.
Figure 4A:
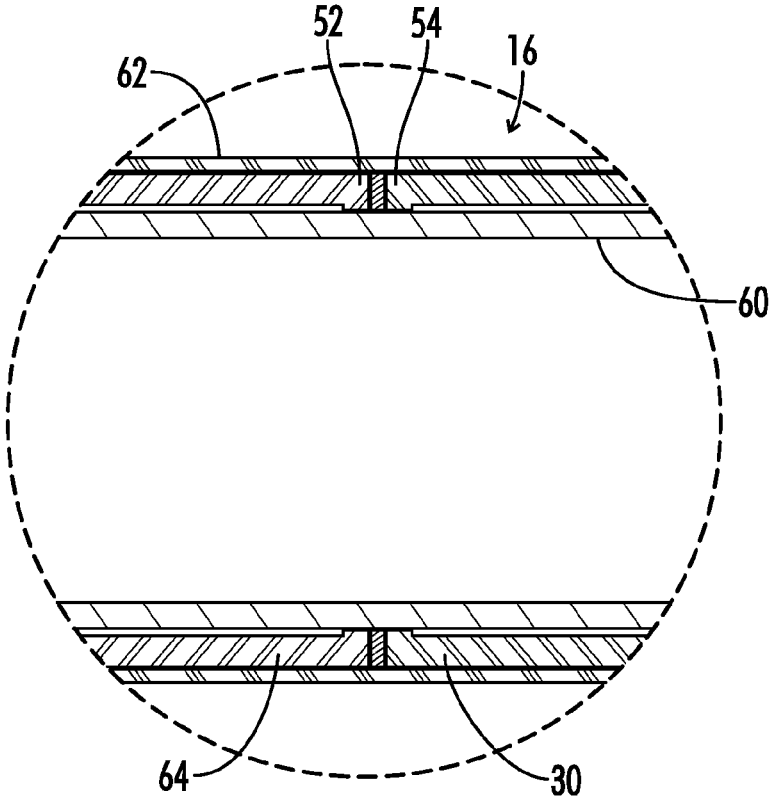
FIG. 4A is a detailed view of the area indicated as 4A in FIG. 4.

Each tubular member can separate from and also spaced from adjacent tubular members. This further facilitates independent deflection of the adjacent tubular members. As detailed in FIG. 4A, there can be a buffer in between adjacent to the members, such as a type of plastic or other spacing material. This again facilitates independent movement while supplying some of the structure that may be needed for performance of the bat.

In operation, the current design preferably does not alter any stiffness of the preferred hitting location. Instead, the current design has the capability of decreasing the stiffness away from the preferred hitting location. As seen in the charts and graphs in FIGS. 8A-9C, the experimental data by the inventors show that the tubular length affects the resistance to barrel compression for a given load. This information is exampled in Chart 1 and plotted in Graph 1. This combined with the experimental data by the inventors that the distance the load is applied from the open tube end also affects the resistance to barrel compression in the tubular structure. This information is exampled in Chart 2 and plotted in Graph 2.

This combined information shows that the invention decreases the stiffness away from the preferred hitting area by taking advantage of the desired resistance to barrel compression of the tubular structures. This improvement in the design of the bat is not dependent upon the thickness of the materials in those locations or the actual materials used in the barrel.

Bats have traditionally had an issue with decreased performance near the end cap section of the barrel. Part of the reason for this decrease in performance is the bats are regularly stiffer at this end due to the fact that the end is sealed with a stiff structure, for example the end cap and a urethane that holds the end cap in place. This decreased stiffness results in a major performance decrease. Traditionally some of this performance drop off is off set due to the additional mass of the cap assembly, which in turn can improve performance in that location.

The current invention creates at least two open ended tubes in the barrel portion of the bat. For example, the first one can be approximately four inches from the cap end of the bat where the first and second tubular members are separated. This separation is away from the preferred hitting location in order to reduce radial stiffness at those locations, which results in a better batted ball performance due to the rebound effect of the ball from the bat.

Thus the current invention creates a varied stiffness along the barrel length with the use of multiple tubular structures that are substantially coaxially aligned and have substantially similar outside diameters. The increased performance is not meant to be dependent upon material thickness, fiber orientation, material type or other adjustments used previously by the prior art.

The current design allows for increased performance of the bat and to obtain performance in sections adjacent to the preferred hitting location that come close to matching, if not matching, the performance limitations placed upon bats by the regulatory agents. In turn, the overall performance of the bat is increased due to the larger area in which the regulated maximum batted ball performance can be achieved.

Figure 5:
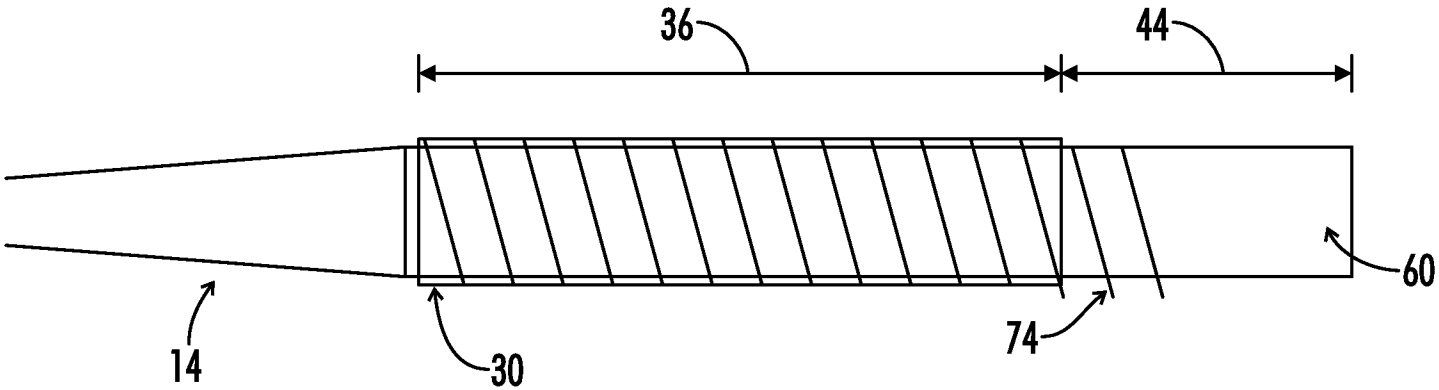
FIG. 5 is a partial view of a bat being constructed in accordance with the current disclosure.
Figure 6:
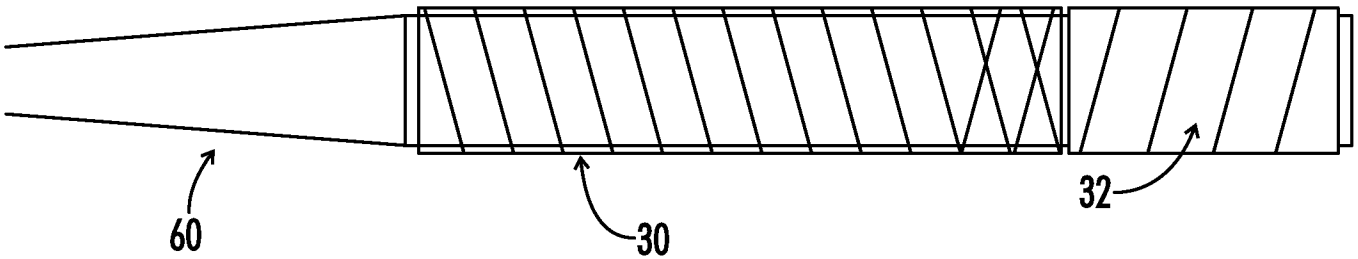
FIG. 6 is a continued construction view of the bat shown in FIG. 5.
Figure 7:
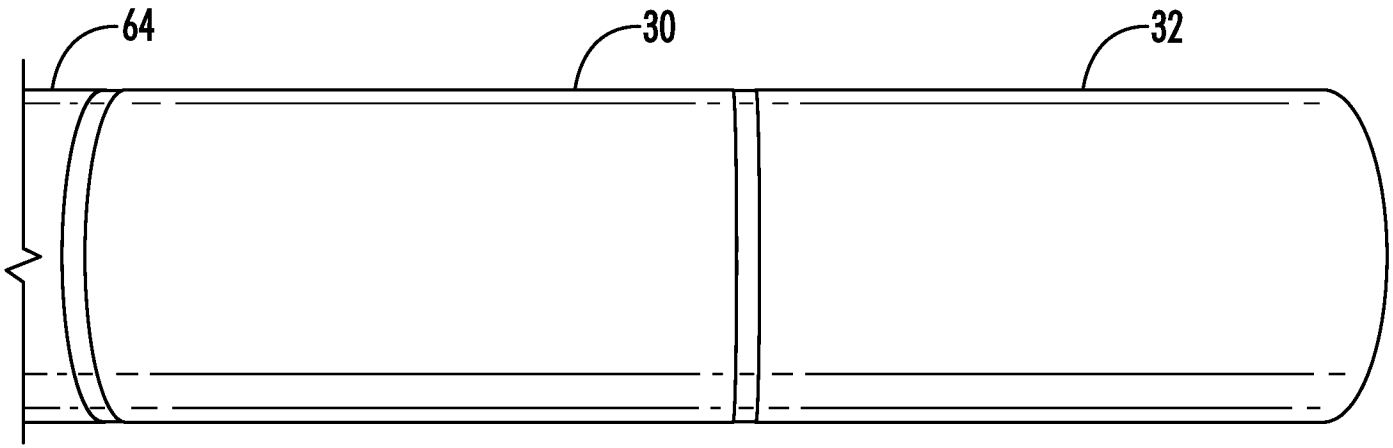
FIG. 7 is a partial side view of a bat similar to FIG. 4.

A method of making a bat in accordance with the current disclosure can be partially shown in FIGS. 5 and 6. In these drawings a polypropylene tape 74 is wound around the frame 60 which can be positioned on a mandrel. Then fibers comprising the first tubular member 30 can be wound around the frame 60. Next fibers that comprise the separate second tubular member 32 can also be wound around the frame 60. These fibers can be wound at various angles as desired. An envelope 62, which can be an additional shell of metal, fiber, urethane, and the like, can be positioned over both tubular members 30 and 32 as desired. An additional composite wrap envelope can be wound over both tubular members and additional handle or taper sections can be formed and the bat can be removed from the mandrel after curing.

Alternately, a pre-impregnated composite wrap that will comprise the first tubular member can be wound directly around a mandrel. Polypropylene tape can be applied to the mandrel at the end of the first tubular member and over lap a portion of the first tubular member. Next, a second pre-impregnated composite wrap that will comprise the second tubular member can be wound directly around a mandrel and the polypropylene tape. These fibers can be wound at various angles as desired. An additional composite wrap envelope can be wound over both tubular members and additional handle or taper sections can be formed and the bat can be removed from the mandrel after curing.

Alternately, a pre-impregnated composite wrap that will comprise both the first and second tubular members can be wound directly around a mandrel and then cut through at the desired location or locations to establish the separate tubular members. An additional composite wrap envelope can be wound over the cut composite wrap and additional handle or taper sections can be formed and the bat can be removed from the mandrel after curing.

Also, a pre-impregnated composite wrap having a width that can encircle the mandrel multiple times can be provided. The pre-impregnated composite wrap can be precut a portion of its width. That portion can approximately equal a circumferential cord length of the mandrel diameter. For example, the pre-impregnated composite wrap can be cut a distance into the width that equals Π times the diameter D of the mandrel (distance cut=Π*D). As such, the first wind of the pre-impregnated composite wrap around the mandrel will create separate tubular structures on the mandrel. The remainder of the pre-impregnated composite wrap can then be wound around the mandrel to provide an additional layer, or envelope, around the separate tubular members. Other additional composite wrap envelopes can also be wound over the cut composite wrap additional handle or taper sections can be formed and the bat can be removed from the mandrel after curing.

The tubular members, if composed of a non-wrapping material such as metal, can be forced or press fit over the frame. This is especially conducive when both the frame and tubular members are composed of metal.

Thus, although there have been described particular embodiments of the present invention of a new and useful Bat with Circumferentially Aligned and Axially Segmented Barrel Section, it is not intended that such references be construed as limitations upon the scope of this invention except as set forth in the following claims.

What is claimed is:

1. A bat for striking a ball comprising:
- an axis;
- a handle portion having a knob;
- a transition portion attached to the handle portion; and
- a barrel portion attached to the transition portion, the barrel portion including an internal portion and a first material having a width and a partial cut along the width, the cut extending substantially around the internal portion of the barrel portion, the first material having an end cap end, a handle end, and a barrel length.

2. The bat of claim 1 wherein the cut forms a first member and a second member, wherein:
- the first member has a first radius and a first length, the first member longitudinally positioned along the axis between the end cap end and the handle end;
- the second member has a second radius and a second length, the second radius approximately equal to the first radius, the second member longitudinally positioned along the axis between the first member and the end cap end of the barrel portion.

3. The bat of claim 2, further including a frame extended the barrel length, wherein the first and second members form a shell around the frame.

4. The bat of claim 3, wherein the handle extends proximate to the handle end of the barrel portion and includes the frame.

5. The bat of claim 2, wherein each member includes a center section and two ends, the first member includes a variable first radial stiffness along the first length and the second member includes a second variable radial stiffness along the second length, the variable radial stiffness of each member is greater in the center section than at either end of said member.

6. The bat of claim 2, the first member including a first outside diameter and the second member including a second outside diameter positioned approximately equal to the first outside diameter.

7. The bat of claim 2 further comprising an envelope covering the first and second members.

8. The bat of claim 2 wherein the first member is axially positioned between the second member and the handle end of the barrel portion.

9. The bat of claim 1 wherein the barrel portion is comprised of composite material.

10. A bat for striking a ball comprising:
- a frame including:
  - a frame diameter;
  - a longitudinal axis;
  - a handle having a knob; and
  - a barrel attached to the handle, the barrel including:
    - an end cap end;
    - a tapered end; and
    - a barrel length;

a composite material connected to the frame along the barrel portion, the composite material having a width and a partial cut along the width, the cut approximately equal to a chord length of the frame diameter.

11. The bat of claim 10 wherein the cut forms a first member and a second member, wherein:

the first member has a first inside diameter, a first outside diameter, and a first length, the first member positioned along the longitudinal axis between the end cap end and the tapered end; and the second member has a second inside diameter, a second outside diameter, and a second length, the second inside diameter approximately equal to the first inside diameter, the second outside diameter approximately equal to the first outside diameter, the second member positioned along the longitudinal axis between the first member and the end cap end of the barrel.

12. The bat of claim 11, wherein the frame extends the barrel length and the first and second members circumferentially surround the frame.

13. The bat of claim 11 further including:

a second cut along the width, the second cut approximately equal to a circumferential cord length of the frame diameter and forming a third member having a third inside diameter and a third outside diameter, the third inside diameter approximately equal to the first and second inside diameters and the third outside diameter approximately equal to the first and second outside diameters, the third member separated from the first and second members and longitudinally positioned along the axis between the first member and the tapered end of the barrel; and wherein the first, second, and third members circumferentially surround the frame.

14. The bat of claim 11, wherein each member includes a center section and two ends, each member including a variable radial stiffness along said length and each the variable radial stiffness of each member is greater in the center section than at either end of said member.

15. The bat of claim 11, wherein the first member includes a first axis and the second member includes a second axis and both the first and second axes are co-linear with the longitudinal axis of the bat and the first member is axially positioned between the second member and the taper end of the barrel.

16. The bat of claim 11 further comprising an envelope covering the first and second members.

17. A bat for striking a ball comprising:

a longitudinal axis;

a handle having a knob; and a barrel attached to the handle, the barrel including:

an end cap end;

a tapered end;

a barrel length; and a composite material having a width and a cut along a partial section of the width, the cut partial section of the width forming first and second members and the uncut section of the width formed around the first and second members.

18. The bat of claim 17 wherein:

the cut is substantially perpendicular to the longitudinal axis;

the first member has a first axis and is positioned between the end cap end and the tapered end;

the second member has a second axis, the second member separated from the first member; and the first and second axes are positioned along the longitudinal axis between the tapered end and the end cap end of the barrel.

19. A bat for striking a ball comprising:

a frame having a longitudinal axis, a handle portion, a knob attached to the handle portion and distal portion opposite the knob; and a barrel attached around the frame, the barrel including:

an end cap end;

a tapered end;

a barrel length;

a first composite material having a width and a partial cut along the width forming first and second members, the uncut section of the width formed around the first and second members.

* * * * *